US005765296A

United States Patent [19]

Ludemann et al.

[11] Patent Number: 5,765,296

[45] Date of Patent: Jun. 16, 1998

[54] EXERCISE SHOE HAVING FIT ADAPTIVE UPPER

[75] Inventors: John F. Ludemann, Cincinnati, Ohio; Kanae H. Koh, Venice, Calif.

[73] Assignee: Nine West Group, Inc., White Plains, N.Y.

[21] Appl. No.: 791,995

[22] Filed: Jan. 31, 1997

[51] Int. Cl.[6] ..... A43C 11/00; A43B 11/00; A43B 3/26

[52] U.S. Cl. ..... 36/51; 36/97; 36/50.1

[58] Field of Search ..... 36/51, 45, 97, 36/138, 50.1

[56] References Cited

U.S. PATENT DOCUMENTS

| | | | |
|---|---|---|---|
| D. 33,990 | 1/1901 | Krohn | 36/51 |
| 575,559 | 1/1897 | Wallner | 36/51 |
| 888,994 | 5/1908 | Gilman | 36/51 |
| 968,964 | 8/1910 | Lutz | 36/51 |
| 1,610,700 | 12/1926 | Morton . | |
| 1,759,583 | 5/1930 | Martin | 36/51 |
| 2,138,385 | 11/1938 | Miller | 36/45 |
| 2,274,085 | 2/1942 | Mitulski | 36/45 |
| 2,311,996 | 2/1943 | Parker | 36/51 |
| 2,591,211 | 4/1952 | Spencer | 36/2.5 |
| 3,388,486 | 6/1968 | Diamant | 36/58.5 |
| 4,270,285 | 6/1981 | Antonious | 36/50 |
| 4,676,011 | 6/1987 | O'Rourke et al. | 36/89 |
| 5,060,402 | 10/1991 | Rosen | 36/97 |
| 5,377,430 | 1/1995 | Hatfield et al. | 36/51 |

*Primary Examiner*—Paul T. Sewell
*Assistant Examiner*—Anthony Stashick
*Attorney, Agent, or Firm*—Senniger, Powers, Leavitt & Roedel

[57] ABSTRACT

An exercise shoe is capable of adapting its fit while being worn. The shoe has a quarter which is split into an upper portion and a side portion on each side of the shoe. In the gap between the upper portion and each respective side portion is an elastic gore which will stretch to permit the upper portion and side portions to move apart from each other as the foot moves during exercise or should the foot swell while being worn. A comfortable fit may be maintained without manipulating the shoelaces. The elastic gore has a substantial resiliency to pull the upper and side portions of the quarter back together as the foot contracts to maintain a secure fit.

13 Claims, 5 Drawing Sheets

EXERCISE SHOE HAVING FIT ADAPTIVE UPPER

BACKGROUND OF THE INVENTION

This invention relates generally to exercise shoes and more particular to exercise shoes which expand and contract to conform to the foot as the foot moves during exercise and as it swells and contracts.

A shoe worn by a person engaging in exercise (e.g., walking and running) must maintain a secure fit to the foot in order to prevent the shoe from rubbing the foot. At the same time, the shoe must not fit so tightly as to squeeze the foot and cause discomfort. The tightness or looseness of the fit is ordinarily controlled by the wearer in the tying of the shoe laces. The laces typically extend forward from over a major portion of the foot. Portion of the shoe upper on both sides of the shoe can be drawn together more or less tightly by manipulation of the laces as desired by the wearer. In some instances laces might be replaced by a strap having a velcro fastener. Thus, the wearer is ordinarily able to achieve a fit of the shoe which is both comfortable and close-fitting by manipulating the laces.

However, during exercise the foot can be moved to several different positions. Although the shoe may have been comfortable and snug when the lace is tied, it may not be comfortable (or sufficiently snug) when moved during exercise. In addition, it is known that during exercise the foot naturally tends to swell. A fit of the shoe which was comfortable for the wearer just prior to beginning the workout may become too tight after the workout has begun. In order to remain comfortable, the wearer must re-tie his shoes to accommodate the increased size of the foot. Further, the foot is likely not to remain swelled during the entire exercise period. If the demands on the foot are reduced for a time, it may tend to contract from its swelled condition. Now the shoe which was loosened to accommodate the swelled foot fits too loosely causing the shoe to rub the foot unless another adjustment is made. The wearer is left with the choice of either enduring the discomfort, or making multiple stops to adjust the lacing.

SUMMARY OF THE INVENTION

Among the several objects and features of the present invention may be noted the provision of an exercise shoe which adapts its fit during while being worn; the provision of such a shoe which does not require readjustment by the wearer during a workout; the provision of such a shoe which remains comfortable if the foot swells; the provision of such a shoe which elastically accommodates foot movements to maintain a snug and comfortable fit; the provision of such a shoe which will not rub the foot if the foot contracts; the provision of such a shoe which expands and contracts with the swelling and contraction of the foot to maintain a secure yet comfortable fit; and the provision of such a shoe which has a durable construction.

An exercise shoe of the present invention for walking, running and the like, is capable to adapt its fit during exercise to accommodate foot movement and also swelling and contraction of the foot. The shoe generally comprises a sole having an upper surface adapted to receive a foot thereon. An upper attached to the sole for overlying at least a portion of the foot as the foot is received on the sole includes a quarter and other upper members defining a volume and a throat for receiving the foot into the volume. The quarter includes an upper portion adapted to overlie a top portion of the foot and side portions adapted to overlie respective side portions of the foot. The upper portion and side portion on each side of the shoe are disposed in spaced apart relation to define a gap therebetween. A gore at least partially disposed in the gap closes the gap and interconnects the upper portion and the side portion of the quarter on each side of the foot. The upper portion and side portion of the quarter are made of a first material and the gore is made of a second material which is more elastic that the first material. The gores are capable of stretching upon movement or swelling of the foot inside the shoe to expand the space between the upper portion and side portion of the quarter on each side of the upper to increase the size of the volume enclosed by the upper, and to contract as the foot moves to a different position or the swelling goes down to pull the upper portion and side portions closer together and decrease the volume enclosed by the upper so that the upper is capable of an adaptive fit to the foot to maintain comfort and security of the fit during exercise.

Other objects and features of the present invention will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF THE PREFERRED EMBODIMENT

Figure 1:
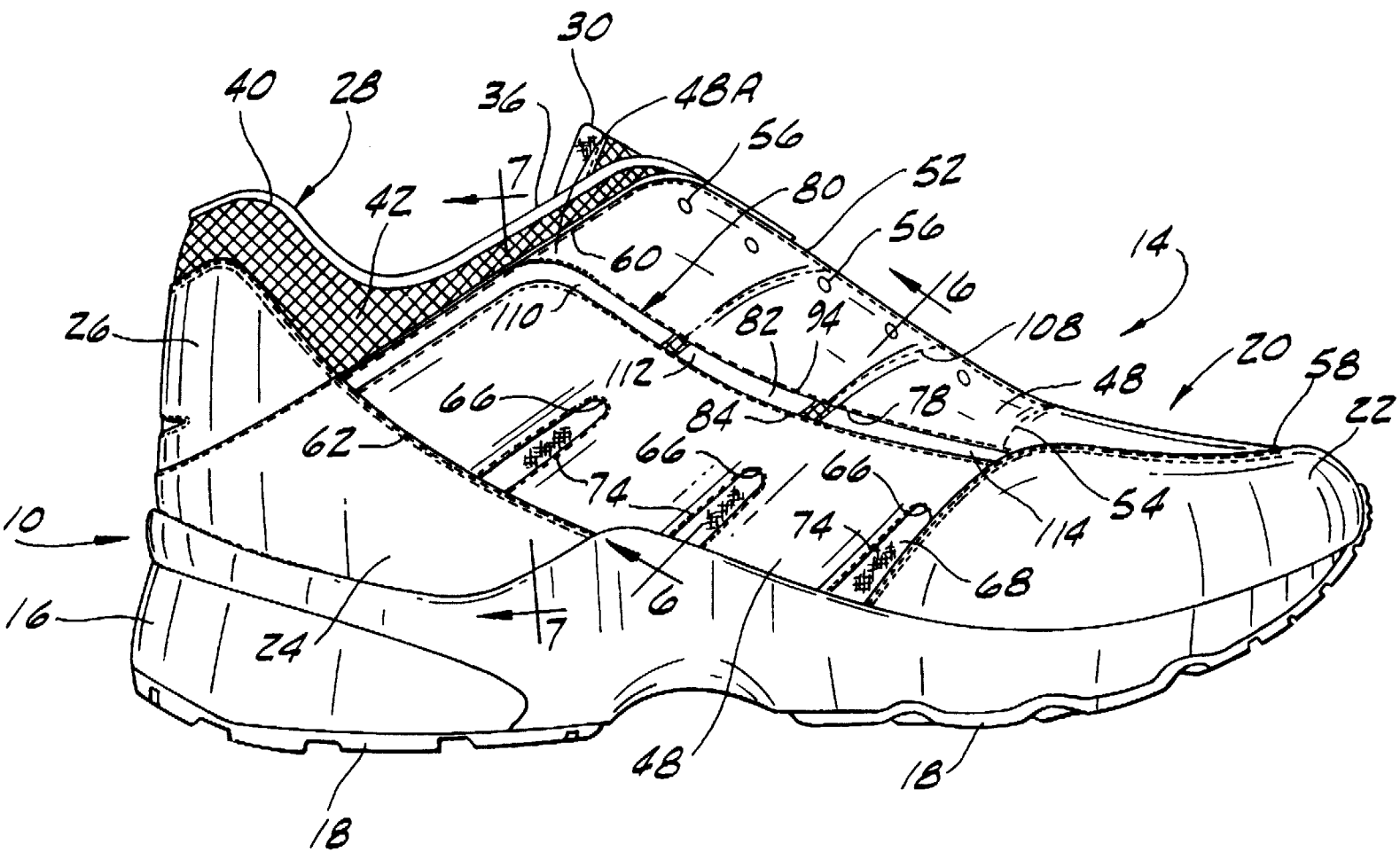
FIG. 1 is a side elevation of a shoe of the present invention showing an upper and a sole.
Figure 2:
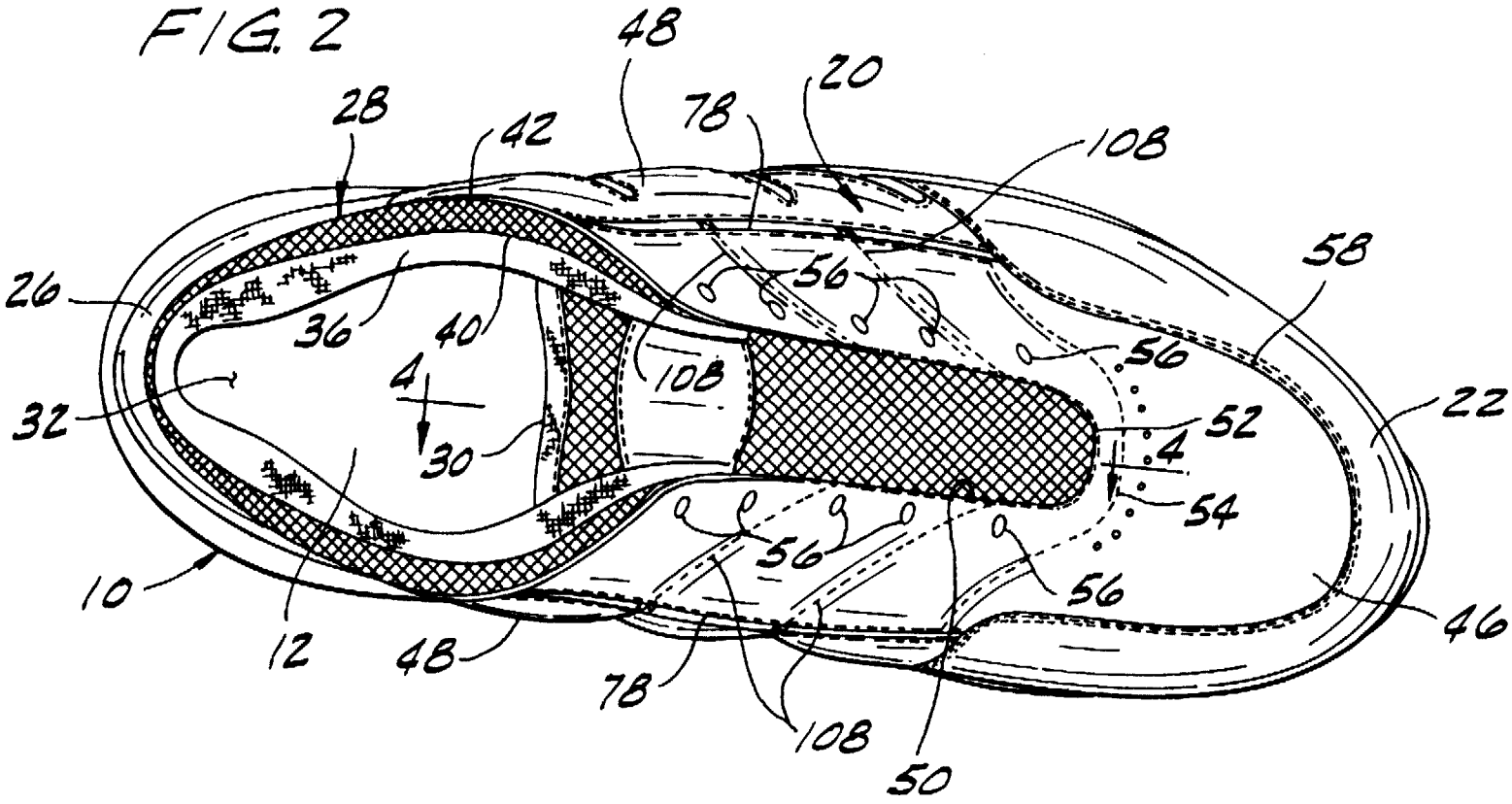
FIG. 2 is a top plan view of the shoe.
Figure 3:
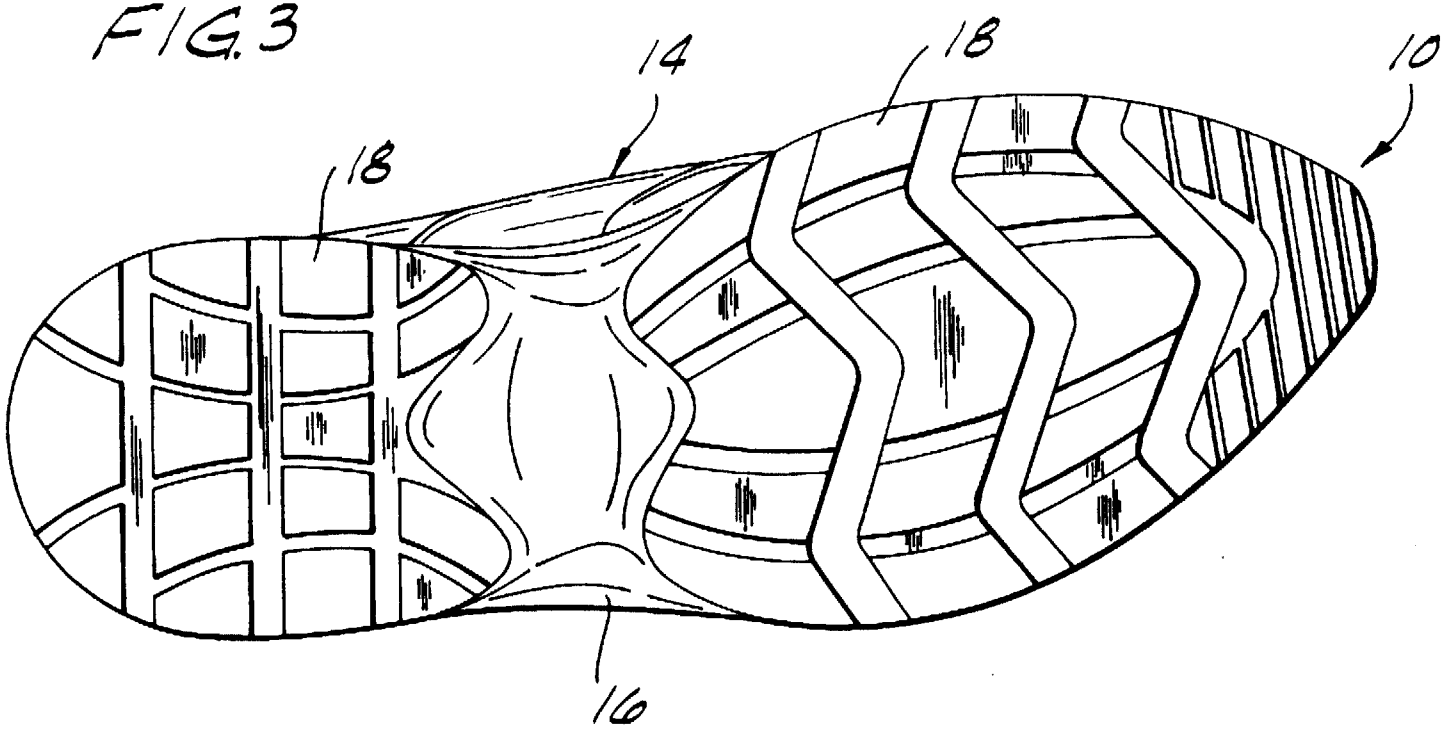
FIG. 3 is a bottom plan view of the shoe.

Referring now to the drawings and in particular to FIGS. 1 and 2, a shoe constructed according to the principles of the present invention is shown to comprise a sole, indicated generally at 10, having an upper surface 12 (FIGS. 2 and 4) adapted to receive a foot (not shown) thereon and an upper, indicated generally at 14, attached to the sole for overlying at least a portion of the foot as received on the sole. The sole 10 includes a midsole 16 and an outsole (comprising two outsole portions 18) having a tread formed thereon (FIG. 3). Typically, there may also be a sockliner (not shown) above the midsole 16 for engaging and cushioning the foot. The upper 14 is made up of several pieces which are joined together, including a quarter, generally indicated at 20, a tip 22, a heel piece 24, and a counter 26. Other pieces of the upper are a collar, generally indicated at 28, and a tongue 30. The pieces forming the upper may be collectively referred to as "the upper members".

The heel piece 24 is made as a single piece in the illustrated embodiment which extends around the heel, but could also be made from two or more separate pieces stitched together with the other pieces of the upper 14. The upper members are arranged to define a volume into which the foot is received when the shoe is worn. The collar 28 and tongue 30 define a throat 32 through which the foot passes into the shoe. The tip 22, heel piece 24 and counter 26 are made of leather or a like material which is pliable, but relatively inelastic. The upper 14 also includes various linings, which will be described in more detail hereinafter, on the inside of the upper members described hereinabove.

Figure 7:
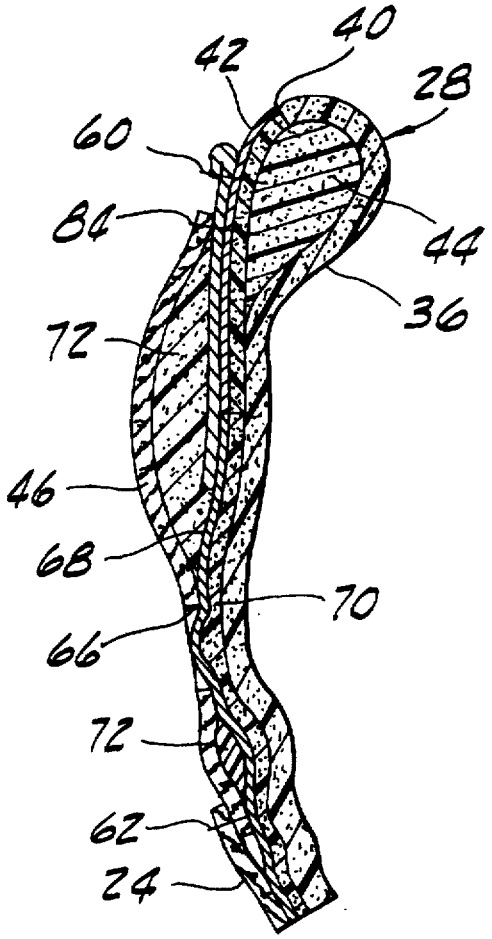
FIG. 7 is an enlarged fragmentary section taken in the plane of line 7—7 of FIG. 1 through one side of the upper.

The collar 28 is defined in part by an interior liner 36 which is padded and has a soft felt-like finish on its interior for engaging the foot. The interior liner 36 is illustrated in FIG. 7 as a unitary piece of padding material for simplicity. However, the padding material is actually bonded to felt interior material and another fabric on its exterior which are not illustrated. The interior liner 36 extends from a sole seam 38 (FIG. 4) where it is joined to the sole 10 up to the top of the upper 14 and curves over to a first collar seam 40 connecting the interior liner to an exterior collar strip 42 made of a fabric including a polymer with a thin foam backing. The backing is not illustrated apart from the fabric for clarity of the drawings. The interior liner 36 and the exterior collar strip 42 are spaced apart internally and contain a soft collar padding 44 (FIG. 7) in the space. The interior liner 36, exterior collar strip 42 and the collar padding 44 extend from the quarter 20 on one side of the upper 14, rearwardly around the throat 32 and to the quarter on the other side of the shoe to define the collar 28.

The quarter 20 includes an upper portion 46, and two side portions 48 located on opposite sides of the shoe. In the illustrated embodiment, the quarter 20 extends from the tip 22 rearwardly on either side to the heel piece 24 and collar 28. The upper portion 46 has an elongate, generally U-shaped cutout 50 which is closed by the tongue 30. The tongue is secured at one end to the quarter 20 at the forward end of the cutout 50 by a first tongue stitch 52 and a second tongue stitch 54 (FIG. 2). The tongue 30 is also glued to the underside of the upper portion 46. Eyelets 56 in the upper portion 46 along opposite sides of the cutout 50 are capable of receiving shoelaces (not shown) for lacing up the shoe. The upper portion 46 of the quarter 20 is joined by tip stitching 58 to the tip 22. Along its rearward upper edge, the upper portion 46 is joined to the exterior collar strip 42 by a collar stitch 60 which is a rearward extension of the first tongue stitch 52. The upper portion 46 is made of leather in the preferred embodiment, but may be made of another suitable material.

The construction of the side portions 48 of the quarter 20 is substantially identical. Therefore, the construction of only one of the side portions will be described. The side portion 48 is joined along a lower edge to the sole 10 by the sole seam 38, along a rearward edge in a heel piece seam 62 to the heel piece 24 and along a forward edge by the tip stitch 58 to the tip 22. The side portion 48 has three elongate breathe holes 66 extending generally upwardly and forwardly from the lower and rearward edges of the side portion. The breathe holes 66 are underlaid with a porous fabric underlayment 68 and a padded liner 70, which are also air permeable. The padded liner 70 includes a thin padding intimately connected to an inner fabric sheet, but for purposes of simplicity has been illustrated as foam padding in FIG. 6. Thus, the interior of the upper 14 may breathe through the breathe holes 66 in the side portion 48. The side portions 48 of the quarter 20 are made of leather in the preferred embodiment, but may be made of other suitable materials.

The porous fabric underlayment 68 lies under the side portion 48 of the quarter 20. There are three pads 72 (FIG. 5, only two being shown) disposed between the side portion 48 and the porous underlayment 68. The pads 72 are secured by gluing to one or both of the side portion 48 and the porous underlayment 68. Stitching 74 around the breathe holes 66 also helps to hold the pads 72 in place.

The upper portion 46 and side portion 48 are spaced apart and define an elongate gap 78. The side portion 48 also appears to be spaced from the exterior collar strip 42 rearwardly of the upper portion 46 so that the gap 78 appears to extend from the tip 22 rearwardly to the counter 26. However, the gap 78 as discussed hereinafter terminates approximately at the rearward tip 48A of the upper portion 46. The gap 78 is closed by an elastic gore, generally indicated at 80. The elastic gore is capable of stretching upon swelling of the foot inside the shoe to expand the gap 78 between the upper portion 46 and the side portion 48 of the quarter 20 on each side of the upper 14 to increase the size of the volume enclosed by the upper and to contract the gap as the foot swelling goes down to pull the upper portion and the side portions closer together and decrease the volume enclosed by the upper. The gap 78 may also be expanded under forces exerted by the foot on the upper 14 during exercise for re-shaping the upper to accommodate the foot. Thus, the upper 14 is capable of an adaptive fit to the foot to maintain comfort and snugness of the fit while the shoe is being worn during exercise.

Figure 4:
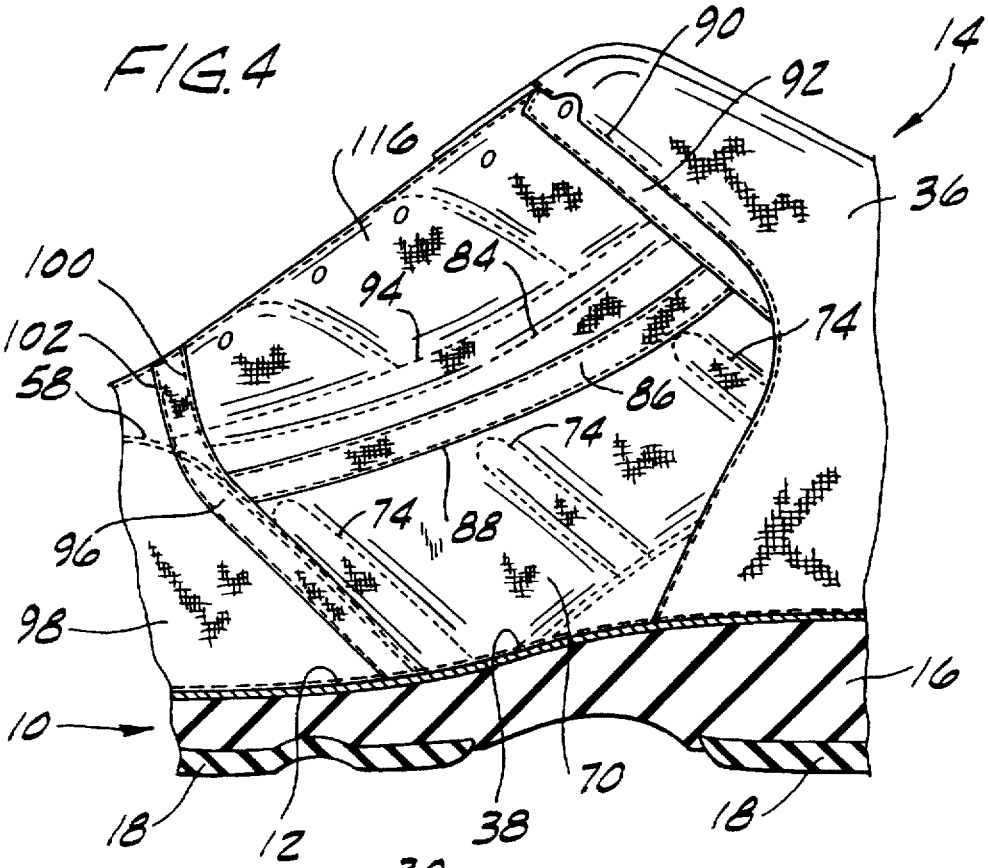
FIG. 4 is a fragmentary longitudinal section taken in the plane including line 4—4 of FIG. 2 with the shoe tongue removed to reveal the internal construction of the shoe in the region of an elastic gore.

Each elastic gore 80 comprises a first gore member 82 of elastic, unitary sheet material, which is in the preferred embodiment a sheet of Lycra. This material will readily stretch under a force in any direction and return to its original configuration when the stretching force is removed. At the same time, the material will provide a barrier to dirt and moisture to keep them from passing into the interior of the shoe. In the illustrated embodiment, the first gore member 82 is a single sheet of material joined along a lower edge margin to the side portion 48 in a lower gap stitch 84 running long the lower edge of the gap 78, and separately along the same edge margin to the porous fabric underlayment 68. The lower gap stitch 84 merges into the collar stitch 60 at the rear of the gap 78. A reinforcing strip 86 connected in the lower gap stitch behind the first gore member 82 also overlaps the underlayment 68 and is secured to the underlayment by a line of stitching 88 (FIG. 4). An upper left edge margin of the first gore member 82 is attached in a second collar seam 90 to the exterior collar strip 42 (see FIG. 5). On the back side of the second collar seam 90 is a second reinforcing strip 92 joined in the seam and overlapping both the collar strip 42 and the first gore member 82 to strengthen the connection.

The first gore member 82 extends up to the first tongue stitch 52, and is joined to the upper portion by the first tongue stitch and also by an upper gap stitch 94 running along the upper edge of gap 78. A forward edge margin of the first gore member 82 is also joined to the tip 22 by the tip stitch 58. A third reinforcing strip 96 overlies the forward edge margin of the first gore member 82 and also a rearward edge margin of a tip liner 98. The third reinforcing strip 96 is attached by stitch lines 100 and 102 to the first gore member 82 and the tip liner 98, respectively (FIG. 4).

Figure 5:
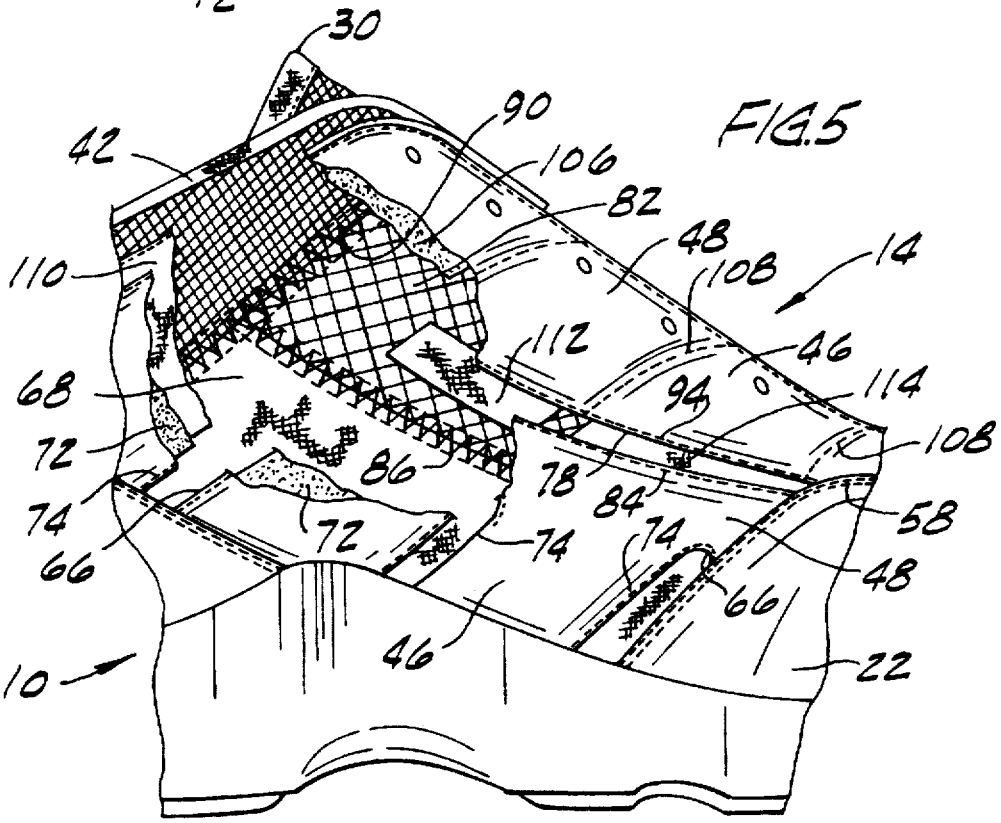
FIG. 5 is a fragmentary side elevation with parts of the upper of the shoe broken away to show the construction of the shoe in the region of the gore.

A pad 106 is disposed between the upper portion 46 of the quarter 20 and the first gore member 82 (FIG. 5). The pad is secured in place by lines of pad stitching 108 which also help to secure the first gore member 82 to the upper portion 46.

The elastic gore 80 further includes a second gore member comprising in the illustrated embodiment three elastic straps (designated 110, 112 and 114, respectively), each extending generally across the gap 78 at an angle. The straps are spaced apart from each other generally lengthwise of the shoe. The straps 110, 112, 114 are made of spandex which is elastic like the material of the first gore member 82, but is much more resilient to urge the elastic gore 80 toward its initial configuration. A first of the straps 110 is joined to the side portion 48 of the quarter 20 and to the heel piece 24 by the heel piece stitch 62. The upper longitudinal edge of the first strap 110 is attached to the exterior collar strip 42 by the collar stitch 60 and is also secured in the lower gap stitch 84. After spanning the gap 78, the first strap is secured to the upper portion 46 by upper gap stitch 94. A second and third of the straps 112, 114 are substantially shorter than the first strap 110. The second and third straps 112, 114 are only slightly longer than the width of the gap 78 so that the straps may extend across the gap at an angle and have end edge margins secured to the upper and lower portion, respectively, by the lower and upper gap stitches 84, 94 on opposite sides of the gap.

Underlying the first and second gore members in the gap 78 is a layer of lightweight, elastic foam padding and under that a lightweight lining of tricot material which is also elastic. The foam padding and tricot material are intimately joined, and are shown in the drawings (FIG. 6) as a unitary piece of elastic padding 116 for simplicity. The elastic padding 116 is joined to the side portion 48 and upper portion 46 by the lower and upper gap stitches 84, 94, and also extends upwardly to the first tongue stitch 52 which further secures the elastic padding to the upper portion 46. A right end margin (as seen in FIG. 4) is joined in the second collar seam 90 connecting the first gore member 82 to the exterior collar strip 42. The padding 116 extends forwardly to the third reinforcing strip 96 to which it is joined by stitch line 100 at the forward end of the gap 78.

Figure 6:
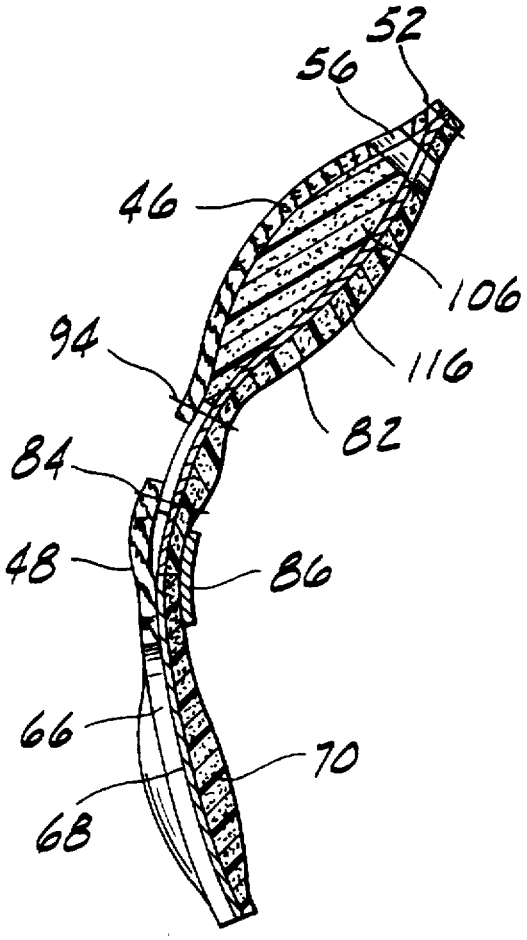
FIG. 6 is an enlarged fragmentary section taken in the plane of line 6—6 of FIG. 1 through one side of the upper.

As shown in FIG. 6, the only components of the upper 14 which span the gap 78 in the portion of the upper where the section is taken are the spandex straps 110, 112, 114, the first gore member 82, and elastic padding 116. All of these are made of elastic material which will permit stretching to widen the gap 78 between the upper portion 46 and side portion 48 of the quarter 20. The construction revealed in the cross section of FIG. 6 is present from the forward end of the gap 78 to the second collar seam 90 between the first gore member 82 and the exterior collar strip 42 (FIG. 5). Referring to FIG. 7, it may be seen that rearwardly of second collar seam 90, the relatively inelastic exterior collar strip 42 is sewn into both the upper gap stitch 94 running along the top edge of the gap 78 and the lower gap stitch 84 running along the bottom edge of the gap. The exterior collar strip 42 material does not permit the gap 78 to be widened by transverse stretching rearwardly of the second collar seam 90.

Thus it may be seen that the several objects and features of the present invention are met in the illustrated embodiment. The quarter 20 can expand and contract with the foot by virtue of the gap 78 and the elastic gore within the gap. It is further noted that there is no fixed transverse connection between he side portions of the quarter 20 forwardly of the collar 28 and rearwardly of the tip 22 except through the elastic gore.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. An exercise shoe for walking, jogging and running, the shoe being capable to adapt its fit during exercise to accommodate foot movement and swelling and contraction of the foot, the shoe comprising:

a sole having an upper surface adapted to receive a foot thereon; and an upper attached to the sole for overlying at least a portion of the foot as the foot is received on the sole, the upper including a quarter and other upper members defining a volume and a throat for receiving the foot into the volume, the quarter including an upper portion adapted to overlie a top portion of the foot and side portions adapted to overlie respective side portions of the foot, the upper portion and side portion on each side of the shoe being disposed in spaced apart relation to define a gap therebetween, and a gore at least partially disposed in the gap to close the gap and interconnect the upper portion and the side portion of the quarter on each side of the foot, the upper portion and side portion of the quarter being made of a first material and the gore being made of a second material which is more elastic than the first material, each gore comprising a first gore member of elastic sheet material selected to stretch and contract while preventing the passage of dirt and moisture into the shoe volume between the upper portion and the side portion of the quarter, the first gore member being joined to the side portion along a first margin and joined to the upper portion along a second margin opposite and spaced apart from the first margin, and second gore member of elastic sheet material being joined to the side portion along a first margin and joined to the upper portion along a second margin opposite and spaced apart from the first margin, the elastic material of the second gore member having a greater resiliency than the first elastic material to urge the upper portion and side portion toward each other, one of the first and second gore members substantially overlying the other of the first and second gore members, the gore members being capable of stretching upon movement or swelling of the foot inside the shoe to expand the gap between the upper portion and side portion of the quarter on each side of the upper to increase the size of the volume enclosed by the upper and to contract the gap as the foot moves to another position or the swelling goes down to pull the upper portion and side portions closer together and decrease the volume enclosed by the upper so that the upper is capable of an adaptive fit to the foot to maintain comfort and security of the fit during exercise.

2. A shoe as set forth in claim 1 wherein the second gore member of each gore comprises multiple elastic straps spaced apart from each other lengthwise of the shoe.

3. A shoe as set forth in claim 2 wherein each first gore member underlies the corresponding second gore members in the gore.

4. A shoe as set forth in claim 3 wherein each first gore member is a unitary sheet of material, the elastic straps of the second gore member overlying the first gore member.

5. A shoe as set forth in claim 4 wherein the upper portion of the quarter has an opening therein, and eyelets through the upper portion on transversely opposite sides of the opening for receiving lacing, one of the upper members comprising a tongue joined to the upper portion adjacent a forward end of the opening and extending to the throat, the tongue being sized and shaped to close the opening.

6. A shoe as set forth in claim 5 wherein the gap has a front end located rearwardly of the front of the shoe, the side portions being free of transverse connection to each other rearwardly of the front end of the gap except through the gores.

7. An exercise shoe for walking, logging and running, the shoe being capable to adapt its fit during exercise to accommodate foot movement and swelling and contraction of the foot, the shoe comprising:

a sole having an upper surface adapted to receive a foot thereon; and an upper attached to the sole for overlying at least a portion of the foot as the foot is received on the sole, the upper including a quarter and other upper members defining a volume and a throat for receiving the foot into the volume, the quarter including an upper portion adapted to overlie a top portion of the foot and side portions adapted to overlie respective side portions of the foot, the upper portion and side portion on each side of the shoe being disposed in spaced apart relation to define a gap therebetween, and a gore at least partially disposed in the gap to close the gap and interconnect the upper portion and the side portion of the quarter on each side of the foot, the upper portion and side portion of the quarter being made of a first material and the gore being made of a second material which is more elastic than the first material, the upper portion of the quarter having an opening therein, and eyelets through the upper portion on transversely opposite sides of the opening for receiving lacing, one of the upper members comprising a tongue joined to the upper portion adjacent a forward end of the opening and extending to the throat, the tongue being sized and shaped to close the opening, each gore comprising a first gore member of elastic sheet material selected to stretch and contract while preventing the passage of dirt and moisture into the shoe volume between the upper portion and the side portion of the quarter, the first gore member being joined to the side portion along a first margin and joined to the upper portion along a second margin opposite and spaced apart from the first margin, and second gore member of elastic sheet material being joined to the side portion along a first margin and joined to the upper portion along a second margin opposite and spaced apart from the first margin, the elastic material of the second gore member having a greater resiliency than the first elastic material to urge the upper portion and side portion toward each other, one of the first and second gore members substantially overlying the other of the first and second gore members, the gores being capable of stretching upon foot movement or swelling of the foot inside the shoe to expand the gap between the upper portion and side portion of the quarter on each side of the upper to increase the size of the volume enclosed by the upper and to contract as the foot moves to another position or the swelling goes down to pull the upper portion and side portions closer together and decrease the volume enclosed by the upper so that the upper is capable of an adaptive fit to the foot to maintain comfort and security of the fit during exercise.

8. A shoe as set forth in claim 7 wherein the gap has a front end located rearwardly of the front of the shoe, the side portions being free of transverse connection to each other rearwardly of the front end of the gap except through the gores.

9. An exercise shoe for walking, jogging and running, the shoe being capable to adapt its fit during exercise to accommodate foot movement and swelling and contraction of the foot, the shoe comprising:

a sole having an upper surface adapted to receive a foot thereon; and an upper attached to the sole for overlying at least a portion of the foot as the foot is received on the sole, the upper including a quarter and other upper members defining a volume and a throat for receiving the foot into the volume, the quarter including an upper portion adapted to overlie a top portion of the foot and side portions adapted to overlie respective side portions of the foot, the upper portion and side portion on each side of the shoe being disposed in spaced apart relation to define a gap therebetween, and a gore at least partially disposed in the gap to close the gap and interconnect the upper portion and the side portion of the quarter on each side of the foot, the upper portion and side portion of the quarter being made of a first material and the gore being made of a second material which is more elastic than the first material, the gap having a front end located rearwardly of the front of the shoe, the side portions being free of transverse connection to each other rearwardly of the front end of the gap except through the gores, each gore comprising a first gore member of elastic sheet material selected to stretch and contract while preventing the passage of dirt and moisture into the shoe volume between the upper portion and the side portion of the quarter, the first gore member being joined to the side portion along a first margin and joined to the upper portion along a second margin opposite and spaced apart from the first margin, and second gore member of elastic sheet material being joined to the side portion along a first margin and joined to the upper portion along a second margin opposite and spaced apart from the first margin, the elastic material of the second gore member having a greater resiliency than the first elastic material to urge the upper portion and side portion toward each other, one of the first and second gore members substantially overlying the other of the first and second gore members, the gores being capable of stretching upon foot movement or swelling of the foot inside the shoe to expand the gap between the upper portion and side portion of the quarter on each side of the upper to increase the size of the volume enclosed by the upper and to contract as the foot moves to another position or the swelling goes down to pull the upper portion and side portions closer together and decrease the volume enclosed by the upper so that the upper is capable of an adaptive fit to the foot to maintain comfort and security of the fit during exercise.

10. A shoe as set forth in claim 9 wherein the second gore member of each gore comprises multiple elastic straps spaced apart from each other lengthwise of the shoe.

11. A shoe as set forth in claim 10 wherein each first gore member underlies the corresponding second gore members in the gore.

12. A shoe as set forth in claim 11 wherein each first gore member is a unitary sheet of material, the elastic straps of the second gore member overlying the first gore member.

13. A shoe as set forth in claim 10 wherein the upper portion of the quarter has an opening therein, and eyelets through the upper portion on transversely opposite sides of the opening for receiving lacing, one of the upper members comprising a tongue joined to the upper portion adjacent a forward end of the opening and extending to the throat, the tongue being sized and shaped to close the opening.

* * * * *

UNITED STATES PATENT AND TRADEMARK OFFICE

CERTIFICATE OF CORRECTION

PATENT NO. : 5,765,296
DATED : June 16, 1998
INVENTOR(S) : John F. Ludemann et al.

It is certified that error appears in the above-identified patent and that said Letters Patent is hereby corrected as shown below:

Column 7, claim 7, line 9, "logging" should read ---jogging---.

Signed and Sealed this

Twenty-fourth Day of November, 1998

*Attest:*

Bruce Lehman

BRUCE LEHMAN

*Attesting Officer*

*Commissioner of Patents and Trademarks*